US005408158A

United States Patent [19]

Hens et al.

[11] Patent Number: 5,408,158

[45] Date of Patent: Apr. 18, 1995

[54] COLOUR CATHODE RAY TUBE HAVING A SCREENING CAP

[75] Inventors: Theodoor C. A. Hens; Jean Winters; Adrianus J. Van Mensvoort, all of Eindhoven, Netherlands

[73] Assignee: U.S. Philips Corporation, New York, N.Y.

[21] Appl. No.: 143,672

[22] Filed: Oct. 27, 1993

[30] Foreign Application Priority Data

Oct. 28, 1992 [EP] European Pat. Off. ..... 92203307

[51] Int. Cl.[6] ..... H01J 29/80

[52] U.S. Cl. ..... 313/402; 313/407

[58] Field of Search ..... 313/402, 407, 408, 479, 313/404

[56] References Cited

U.S. PATENT DOCUMENTS 4,472,657 9/1984 Sakurai et al. ..... 313/402
4,652,792 3/1987 Tokita et al. ..... 313/407
5,023,507 6/1991 Dougherty et al. ..... 313/407
5,298,832 3/1994 Jeong et al. ..... 313/407

OTHER PUBLICATIONS

R. Casanova Alig & Ralph J. D'Amato, Computer-Aided Design And Analysis Of Magnetic Shields For Color Picture Tubes, Proceedings of the SID, vol. 30/4, 1989, pp. 287-296.

*Primary Examiner*—Stephen Brinich
*Attorney, Agent, or Firm*—Paul R. Miller

[57] ABSTRACT

A color cathode ray tube comprises a color selection electrode which is secured to a frame and a magnetic screening cap. The frame has two diaphragm portions one of which is located near the color selection electrode and the other is further removed from the color selection electrode. The distance between the electron beams deflected towards the outermost apertures of the color selection electrode and the further removed diaphragm is at least 1 cm. By virtue thereof, the negative influence of the frame on the screening effect of the magnetic screening cap is substantially reduced.

5 Claims, 2 Drawing Sheets

COLOUR CATHODE RAY TUBE HAVING A SCREENING CAP

Figure 1:
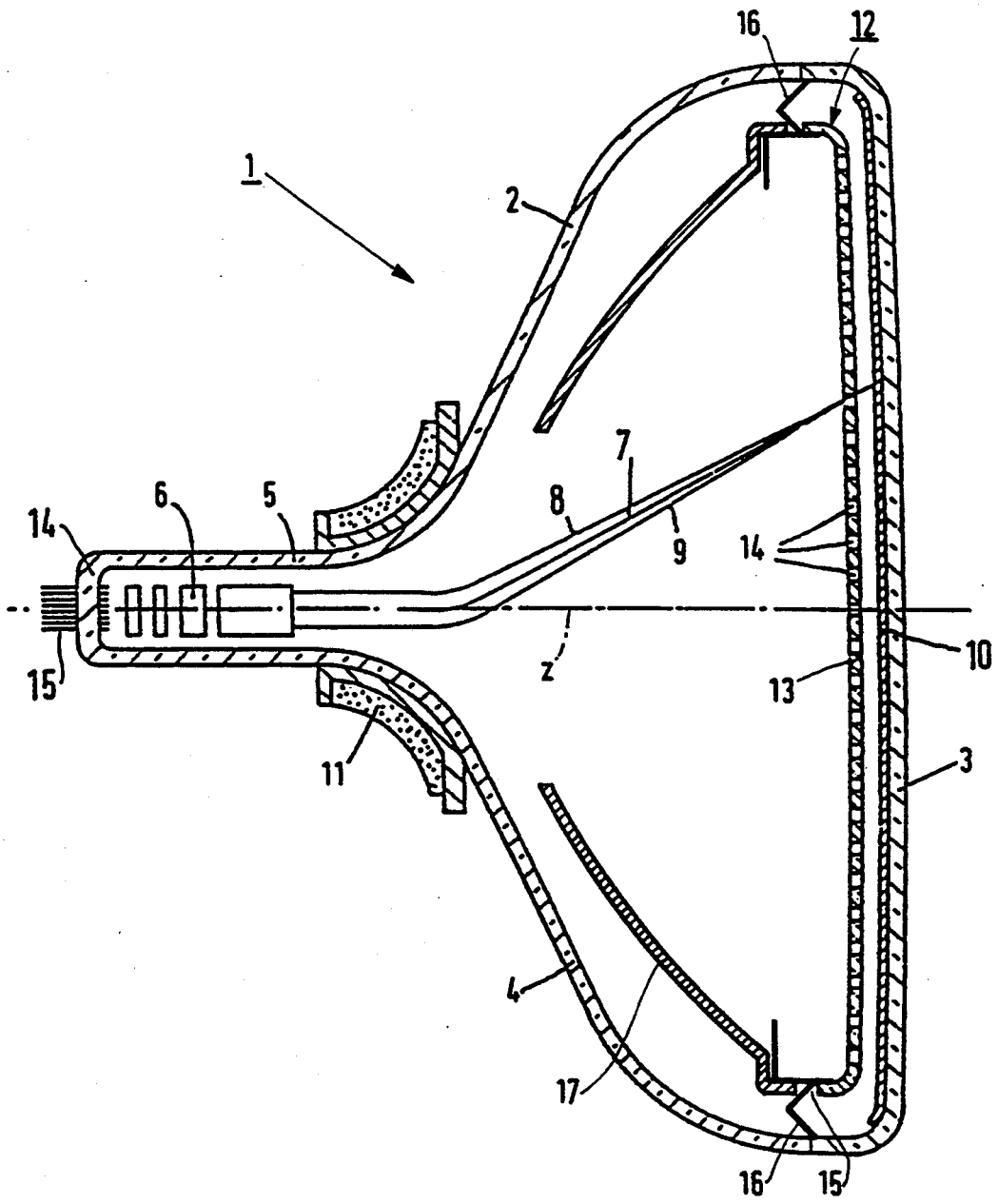

The invention relates to a colour cathode ray tube which comprises an evacuated envelope having a longitudinal axis, a means for generating at least one electron beam, a magnetic screening cap, a colour selection electrode which is secured to a frame and a phosphor screen being accommodated in the envelope, and the colour cathode ray tube further comprises a means for deflecting the electron beams across the colour selection electrode.

BACKGROUND OF THE INVENTION

Such colour cathode ray tubes are known and are used, inter alia, in television receivers and computer monitors.

The magnetic screening cap serves to reduce the influence of disturbing magnetic fields, such as the earth's magnetic field, on the electron beams. Deviations in the paths of electron beams caused by disturbing magnetic fields adversely affect the picture quality.

SUMMARY OF THE INVENTION

It is an object of the invention to reduce the influence of disturbing magnetic fields.

For this purpose, the cathode ray tube in accordance with the invention is characterized in that the frame comprises a first and a second diaphragm portion which extend transversely to the longitudinal axis, the first diaphragm portion being further removed from the colour selection electrode than the second diaphragm portion, and the distance between the first diaphragm portion and the electron beams deflected toward the outermost apertures of the colour selection electrode being at least 1 cm.

Within the framework of the invention it has been found that, despite the use of a magnetic screening cap, disturbing influences caused by magnetic fields occur in the known colour cathode ray tubes, particularly at the edges of the image displayed on the screen. Within the framework of the invention it has been recognized that this is caused by the hitherto customary construction of the frame. In known colour cathode ray tubes, the frame comprises a diaphragm portion which is located at a relatively great distance from the colour selection electrode. Electron beams which are deflected toward the outermost apertures of the colour selection electrode skim along the edge of the diaphragm portion. If the electron beams are deflected even further, i.e. the so-called overscan, the electron beams are incident on the diaphragm portion. At a short distance from the diaphragm portion the screening effect of the screening cap is negatively influenced by the diaphragm portion. As a result, deviations occur at the location where the electron beams are incident on the phosphor screen. These deviations are in the range from, 10–15 μm, for example. By increasing the above-mentioned distance to at least 1 cm, a considerable reduction in the deviation (for example, of the order of 5 μm) is obtained.

Preferably, the second diaphragm portion is so formed and, in operation, the electron beams are so deflected that during a part of the deflection operation the electron beams are deflected beyond the outermost apertures of the colour selection electrode and impinge on the second diaphragm portion.

Due to this, the second diaphragm is heated during operation. This diaphragm radiates a part of this heat to the nearby edge of the colour selection electrode, so that the temperature of the edge of the colour selection electrode increases. As a result, the difference in temperature between the edge of the colour selection electrode and other parts of the colour selection electrode decreases. This has a favourable effect on the picture quality, more particularly, doming of the colour selection electrode is reduced.

A further preferred embodiment of the colour cathode ray tube in accordance with the invention is characterized in that the second diaphragm portion extends at an angle of less than 90° with respect to the longitudinal axis. This reduces the distance between the second diaphragm portion and the edge of the colour selection electrode, so that heat transfer from the second diaphragm to the colour selection electrode is improved.

A preferred embodiment of the colour cathode ray tube in accordance with the invention is characterized in that the frame is formed in such a manner that electron beams reflected by the frame do not cause electrons which are reflected in the direction of the colour selection electrode.

Electrons reflected by the frame, which are reflected in the direction of the colour Selection electrode, can pass through the apertures of the colour selection electrode and impinge on the phosphor screen. This results in a reduced contrast of the image displayed. This adverse effect is precluded in the above-mentioned preferred embodiment.

BRIEF DESCRIPTION OF THE INVENTION

Figure 2:
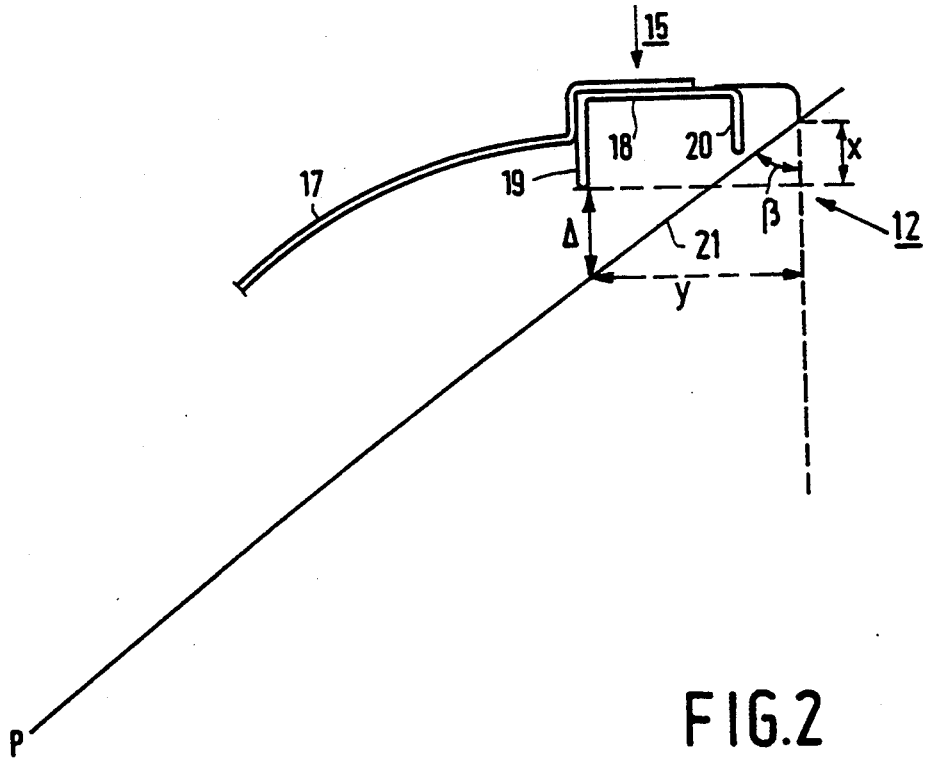
Figure 3:
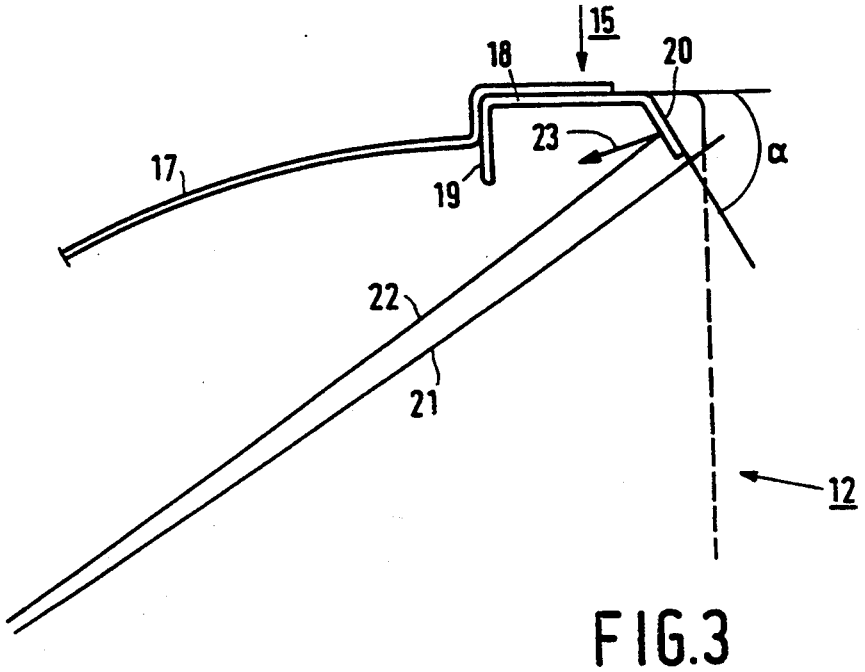

These and other aspects of the invention will be explained in greater detail by means of exemplary embodiments and with reference to the accompanying drawing, in which Fig. 1 shows a colour cathode ray tube;

FIG. 2 shows a detail of a colour cathode ray tube in accordance with the invention; and FIG. 3 shows details of further embodiments of a colour cathode ray tube.

The Figures are diagrammatic and are not drawn to scale. Corresponding parts generally bear the same reference numerals.

DESCRIPTION OF THE INVENTION

Colour cathode ray tube 1 (FIG. 1) has an evacuated envelope 2 comprising a display window 3, a cone portion 4 and a neck 5. In the neck there is provided a means, in this example an electron gun 6, for generating, in this example three, electron beams 7, 8 and 9. A phosphor screen 10 is provided on the inside of the display screen. The phosphor screen 10 comprises a phosphor pattern having phosphor elements luminescing in red, green and blue. On their way to the phosphor screen 10 the electron beams 7, 8 and 9 are deflected across the phosphor screen 10 by means of a deflection unit 11 and pass through a colour selection electrode 12 which is arranged in front of the phosphor screen 10 and which comprises a thin plate 13 having apertures 14. In the undeflected state, the electron beam substantially coincides with the longitudinal axis (z). The colour selection electrode 12 is secured to a frame 15 and suspended in the display window by means of suspension means 16, as diagrammatically shown in FIG. 1. The three electron beams 7, 8 and 9 pass through the apertures of the colour selection electrode at a small angle with each other, and consequently, each electron beam impinges on phosphor elements of only one colour.

The colour cathode ray tube further comprises a screening cap 17. The screening cap may be secured, for example, to the frame 15 or to the suspension beams 16, for example by means of welding or clamping.

The screening cap 17 serves to minimize the influence of disturbing magnetic fields, such as the earth's magnetic field, on the path of the electron beams 7, 8 and 9.

FIG. 2 is a sectional view of a detail of the cathode ray tube. It shows the colour selection electrode 12 and the frame 15. Frame 15 comprises a portion 18 which extends at least substantially parallel to the longitudinal axis(z) of the colour cathode ray tube, a first diaphragm portion 19 and a second diaphragm portion 20. The first diaphragm portion 19 is further removed from the colour selection electrode than the second diaphragm portion 20. This Figure shows path 21 of an electron beam which is deflected toward the outermost apertures in the colour selection electrode. In this example, the path corresponds to a line drawn between the relevant outermost aperture and deflection point P of the colour cathode ray tube. The distance Δ between the first diaphragm portion 19 and the path 21 is at least 1 cm. The distance Δ can be calculated from the angel of deflection $\beta$ of the electron beam passing through the relevant outermost aperture and from the indicated distances x and y, in the following manner:

$$\Delta = \frac{\cos\beta}{\sin\beta} - x.$$

The distance y is the distance parallel to the longitudinal axis between the edge of diaphragm portion 19 and colour selection electrode 12, and the distance x is the distance, transverse to the longitudinal axis, between the edge of the diaphragm portion 19 and the outermost aperture of the colour selection electrode 12.

At a short distance from the diaphragm portion 19 the screening effect of the screening cap 17 is negatively influenced by the diaphragm portion 19. This brings about deviations at the location where the electron beams are incident on the phosphor screen. In known colour display tubes the deviations are in the range from 10–15 μm, for example. If the distance Δ is at least 1 cm, a substantial reduction (for example, to a deviation of the order of 5 μm is attained.

Preferably, the second diaphragm portion 20 is so formed and the electron beams are so deflected, in operation, that during a part of the deflection process (during the over scan) the electron beams are deflected beyond the outermost apertures of the colour selection electrode and impinge on the second diaphragm portion. As a result, the second diaphragm portion 20 is heated in operation. The diaphragm portion 20 radiates a part of this heat to the nearby edge of the colour selection electrode, causing the temperature of the edge of the colour selection electrode to increase. As a result, the difference in temperature between the edge of the colour selection electrode and other parts of the colour selection electrode decreases. This has a favourable effect on the picture quality, more particularly, doming of the colour selection electrode is reduced.

Preferably, the second diaphragm portion extends at an angle $\alpha$ of less than 90° with respect to the longitudinal axis, as is shown in FIG. 3. Relative to an angle of 90°, this leads to a smaller distance between the second diaphragm portion and the edge of the colour selection electrode, so that the heat transfer from the second diaphragm to the colour selection electrode is improved.

Preferably, $\alpha$ is smaller than 45°. In this case, electrons reflected by the second diaphragm portion cannot impinge on the phosphor screen via a second reflection at the frame. This results in an improved contrast.

Preferably, the frame is formed in such a manner that electron beams reflected by the frame do not cause electrons which are reflected in the direction of the colour selection electrode. In this example electrons 22 incident on the second diaphragm portion are reflected in a direction 23 away from the colour selection electrode. Electrons reflected by the frame, which are reflected in the direction of the colour selection electrode, can pass through the apertures in the colour selection electrode and impinge on the phosphor screen. This causes a contrast reduction of the image displayed.

It will be obvious that the invention is not limited to the examples given herein and that, within the scope of the invention, many variations are possible to those skilled in the art.

We claim:

1. A colour cathode ray tube which comprises an evacuated envelope having a longitudinal axis, a means for generating at least one electron beam, a magnetic screening cap, a colour selection electrode which is secured to a frame and a phosphor screen being accommodated in said envelope, and said colour cathode ray tube further comprises a means for deflecting electron beams across the colour selection electrode, characterized in that the frame comprises a first and a second diaphragm portion which extend transversely to the longitudinal axis, the first diaphragm portion being further removed from the colour selection electrode than the second diaphragm portion, and the distance between the first diaphragm portion and the electron beams deflected toward the outermost apertures of the colour selection electrode being at least 1 cm, and characterized in that the second diaphragm portion is so formed and, in operation, the electron beams are so deflected that during a part of the deflection operation the electron beams are deflected beyond the outermost apertures of the colour selection electrode and impinge on the second diaphragm portion.

2. A colour cathode ray tube as claimed in claim 1, characterized in that the second diaphragm portion extends at an angle $\alpha$ of less than 90° with respect to the longitudinal axis.

3. A colour cathode ray tube as claimed in 2, characterized in that the frame is formed in such a manner that electron beams reflected by the frame do not cause electrons which are reflected in the direction of the colour selection electrode.

4. A colour cathode ray tube as claimed in claim 2, characterized in that the angle $\alpha$ is smaller than 45°.

5. A color cathode ray tube as claimed in claim 1, characterized in that the frame is formed in such a manner that electron beams reflected by the frame do not cause electrons which are reflected in the direction of the color selection electrode.

* * * * *